US007207343B2

(12) United States Patent
Earnshaw et al.

(10) Patent No.: US 7,207,343 B2
(45) Date of Patent: Apr. 24, 2007

(54) TILTING UMBRELLA WITH ACTUATOR HAVING OPERATING LOCATION ON LOWER SHAFT TO TILT UPPER SHAFT

(75) Inventors: John Michael Earnshaw, Huddersfield (GB); Michael Harold Bly, Huddersfield (GB)

(73) Assignee: Hoyland Fox Limited, Sheffield (GB)

( * ) Notice: Subject to any disclaimer, the term of this patent is extended or adjusted under 35 U.S.C. 154(b) by 303 days.

(21) Appl. No.: 10/478,270

(22) PCT Filed: May 21, 2002

(86) PCT No.: PCT/GB02/02358

§ 371 (c)(1),
(2), (4) Date: May 25, 2004

(87) PCT Pub. No.: WO02/094053

PCT Pub. Date: Nov. 28, 2002

(65) Prior Publication Data

US 2004/0187900 A1 Sep. 30, 2004

(30) Foreign Application Priority Data

May 22, 2001 (GB) ..... 0112438.7

(51) Int. Cl.
*A45B 17/00* (2006.01)

(52) U.S. Cl. ..... 135/20.1; 135/20.3; 135/28; 135/38

(58) Field of Classification Search ..... 135/20.1, 135/20.3, 28, 37, 38, 39, 41
See application file for complete search history.

(56) References Cited

U.S. PATENT DOCUMENTS 2,724,396 A 11/1955 Pereira (Continued)

FOREIGN PATENT DOCUMENTS

AU 83812 A * 10/1983

(Continued)

OTHER PUBLICATIONS

Derwent Document No. 1983-D7744K, English language abstract of patent publication AU-8283812-A to House, published Feb. 10, 1983 (1 page).*

*Primary Examiner*—Tamara L. Graysay
(74) *Attorney, Agent, or Firm*—Antonelli. Terry, Stout & Kraus, LLP.

(57) ABSTRACT

An umbrella frame includes an upper shaft part 2 and a lower shaft part 1, the two parts being connected by a tilting joint to enable the upper part to tilt with respect to the lower, a runner 4 sliding on the lower shaft part 1, for spreading a cover on the umbrella frame into its unfurled configuration when slid upwardly, and an actuator connected to the upper shaft part 2 and passing down the shaft, through or past the runner 4 when in its upper position with the umbrella open, to an operating location on the lower shaft part 1, the actuator being accessible at its lower end to allow an operator to tilt the upper shaft part 2.

13 Claims, 5 Drawing Sheets

U.S. PATENT DOCUMENTS

| | | | | | |
|---|---|---|---|---|---|
| 3,182,673 | A | | 5/1965 | Small | |
| 3,850,186 | A | * | 11/1974 | Weber et al. | 135/20.3 |
| 3,926,202 | A | * | 12/1975 | Uthemann et al. | 135/20.3 |
| 4,674,522 | A | * | 6/1987 | Ma | 135/20.3 |
| 4,697,606 | A | | 10/1987 | Ma | |
| 5,029,596 | A | | 7/1991 | Tung | |
| 5,086,797 | A | * | 2/1992 | Earnshaw et al. | 135/20.1 |
| 5,871,024 | A | * | 2/1999 | Vanderminden, Sr. | 135/20.1 |

FOREIGN PATENT DOCUMENTS

| | | | | |
|---|---|---|---|---|
| DE | 2259192 | | * | 12/1972 |
| DE | 4407188 | C1 | * | 12/1994 |
| EP | 0368539 | | | 5/1990 |
| EP | 1040771 | | | 10/2000 |
| EP | 1297761 | A1 | * | 4/2003 |
| FR | 2717208 | | | 9/1995 |
| WO | 9956579 | | | 11/1999 |

* cited by examiner

TILTING UMBRELLA WITH ACTUATOR HAVING OPERATING LOCATION ON LOWER SHAFT TO TILT UPPER SHAFT

The invention concerns a mechanism for tilting an umbrella and is particularly useful for a sun umbrella or parasol of the type that is used to provide shade or shelter at tables and so on. The tilting facility allows the cover of the umbrella to be angled as required by the position of the sun or the direction of wind or rain.

Larger static umbrellas are often operated by means of a handle mechanism such as a crank or draw cord, because the top of the umbrella is too high to reach or is too heavy. The handle is provided at a level easy for the user to reach and is connected by some mechanism such as a chain, cord or rack to the runner of the umbrella, i.e. the moving part to which the stretchers are attached. The crank thus serves both to lift and lower the runner to raise the umbrella into its unfurled position, and to lower it again when required.

Tilting of the umbrella can most simply be carried out by hand. However, some "automatic" versions exist in which the tilting action takes place as the runner reaches its top position, i.e. when the umbrella is completely unfurled. At this point further movement of the runner engages a further member associated with the shaft near the tilting joint, causing the tilt to be carried out. In most tilting umbrellas, such as for instance in U.S. Pat. No. 3,850,186 (Weber et al.), U.S. Pat. No. 4,697,606 (Ma) or U.S. Pat. No. 5,029,596 (Tung) the runner first slides on to the upper shaft part, and then tilts with it.

There also exist devices of the type shown in U.S. Pat. No. 3,182,673 and others by S N Small, where the tilt is above the runner. While these have been known for a long time they involve the disadvantage that the insertion of a considerable number of connecting parts into the shaft is problematic from the manufacturing point of view.

WO 99/56579 by the present applicant discloses a tilting umbrella wherein the tilting hinge is located above the runner and the tilting action is brought about by movement of the runner, as in the Small patents. However, in contrast to the Small patents the runner pushes a lever connected to and arranged outside the upper shaft part. This avoids the problem of having numerous connecting parts within the shaft and therefore is beneficial from a manufacturing perspective.

However, this umbrella and the Small patents suffer the problem that the tilting mechanism is dependent on the mechanism that moves the runner. Therefore, when the runner is in the position wherein the cover of the umbrella is fully unfurled with the cover stretched, and the further movement of the runner is transformed into tilting of the umbrella, the tilting travel is against the cover tension, thereby requiring more effort from the user.

It is an aim of the present invention to mitigate the various disadvantages of the prior art devices, and furthermore to provide a tilting mechanism that has few parts and requires little modification to the basic umbrella construction.

SUMMARY OF THE INVENTION

According to the invention there is provided an umbrella frame including an upper shaft part and a lower shaft part, the two parts being connected by a tilting joint to enable the upper part to tilt with respect to the lower, a runner sliding on the lower shaft part, for spreading the cover of the umbrella into its unfurled configuration when slid upwardly, and an actuator connected to the upper shaft part and passing down the shaft, through or past the runner when in its upper position with the umbrella open, to an operating location on the lower shaft part, the actuator being accessible at its lower end to allow an operator to tilt the upper shaft part.

The actuator may comprise a lever and cranked rod arrangement wherein a lever is disposed outside the upper shaft part and is pivotably connected to the upper shaft part at its top end and to the rod at its bottom end, the upper cranked end of the rod extending through an axial slot in the lower shaft part and the body of the rod extending axially downwards to an operating location.

The rod may extend axially downwards inside or outside the lower shaft part; if the lower shaft part is not hollow the rod may extend, for instance, in an axial groove on the surface of the lower shaft part.

The cranked end of the rod may alternatively connect directly to a pivot extension of the upper shaft part, horizontal movement of the pivot being accommodated by allowing the rod to slide through the pivot joint or by simple flexing of the rod, or a combination of both.

At the operating location, the lower end of the rod may likewise be bent outwards to extend through a second slot in the lower shaft so as to be accessible directly. Alternatively a lever mechanism can be interposed, such as a sleeve surrounding the shaft with an internal recess in the form of a helical screw. The lower end of the rod engages in the recess and, with the sleeve held captive but rotatable about the shaft axis, is raised or lowered by rotating the sleeve. The sleeve could be incorporated into the mechanism used for unfurling the umbrella. Another possibility is to have the lower end of the rod connected to a second lever at the operating location, enabling the operator to tilt the upper shaft by moving the second lever. Any other lever mechanism can be considered, e.g. rack-and-pinion, cam or crank. Furthermore any of these mechanisms can be operated manually or by means of a motor.

Because the tilting lever is outside the shaft the modification of the shaft construction can be minimised. The invention preserves the advantage of stability afforded by having the runner slide only on the lower shaft part, i.e. with the tilt joint above the runner. Also the lever arrangement allows a particularly simple construction with at most four moving parts other than the runner, namely the two levers, the rod, and the upper shaft part. If the rod is moved directly by means of a handle or knob attached to its lowermost end, only three moving parts are needed other than the runner, or only two if the rod is connected directly to the upper shaft part.

Preferably, the tilt axis is located radially outwards of the axis of the shaft, and the attachment of the lever to the upper shaft is about a hinge generally on a level with and parallel to the tilt axis, on the opposite side with respect to the axis of the umbrella shaft so as to afford the necessary leverage. The system can then be well counterbalanced, with little force needed for the tilt action.

The runner can be raised by hand or by means of a crank, draw cord or other means lower down on the lower shaft part, i.e. accessible to a user, and in the case of a crank some device such as a cable or rack mechanism for transforming the turning action into a lift of the runner. The raising mechanism can be integrated with the tilt lever mechanism, if present.

For a better understanding of the invention an embodiment of it will now be described, by way of example, with reference to the accompanying drawings, in which.

Figure 3:
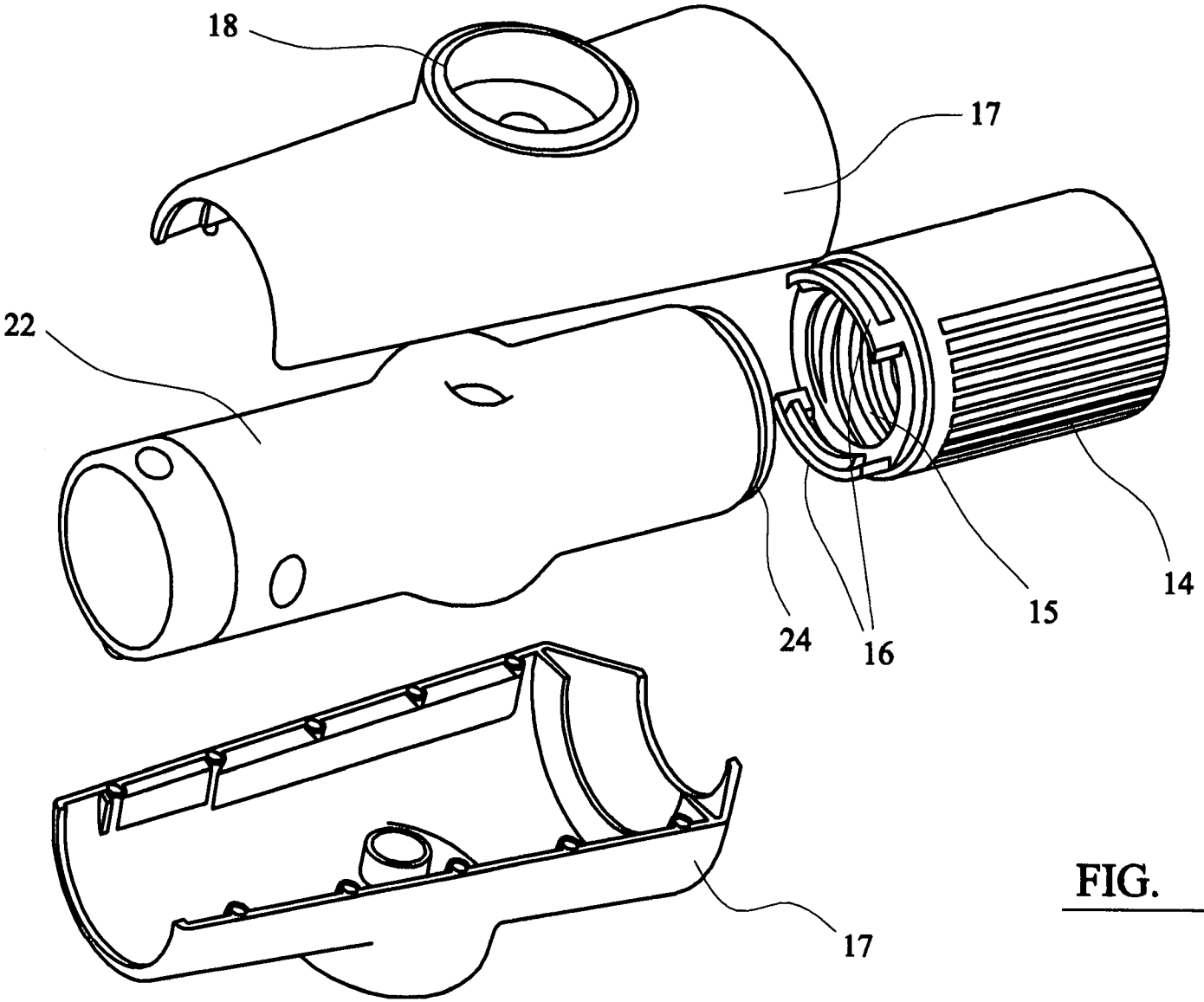
FIG. 3 shows an exploded perspective view of a tilting mechanism assembly representing a third embodiment of the invention.
Figure 4A:
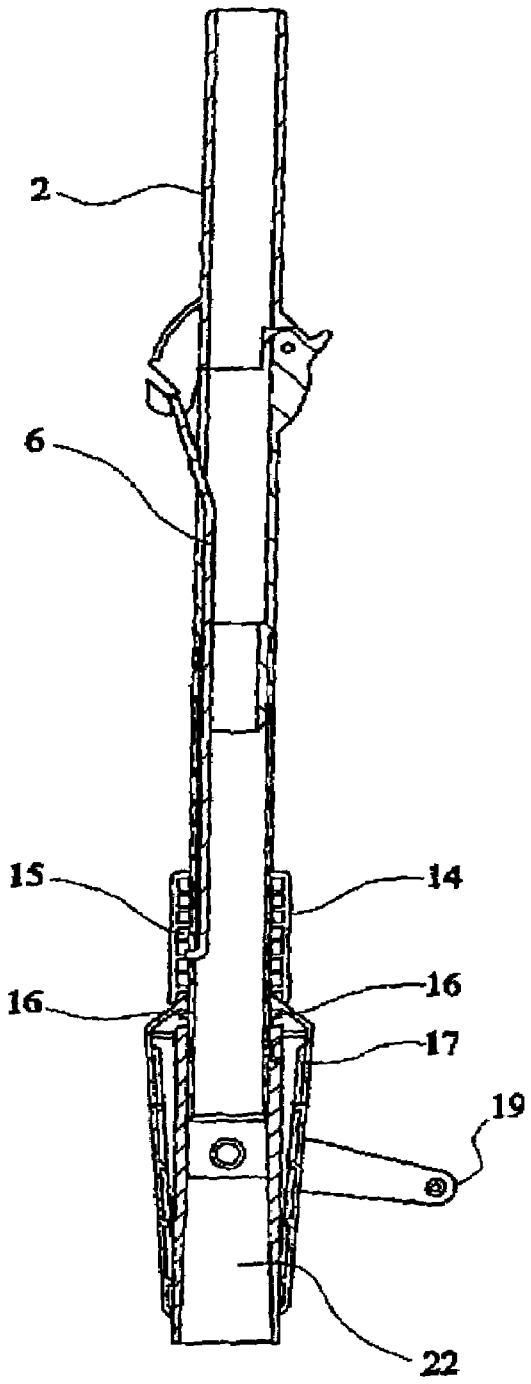
Figure 4B:
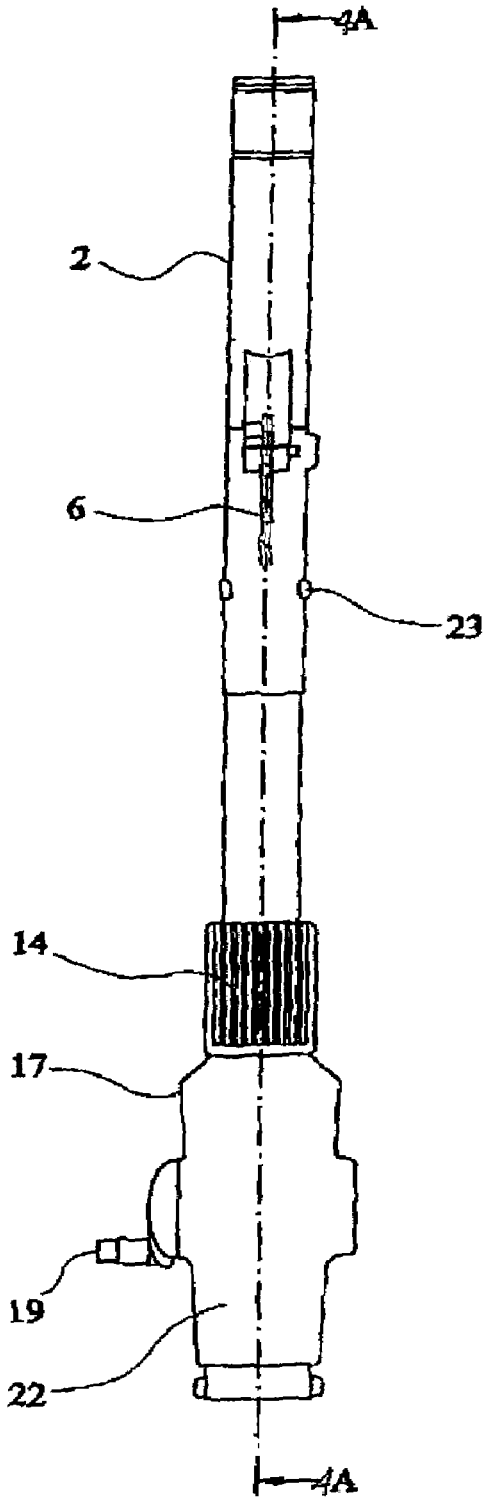
Figure 5:
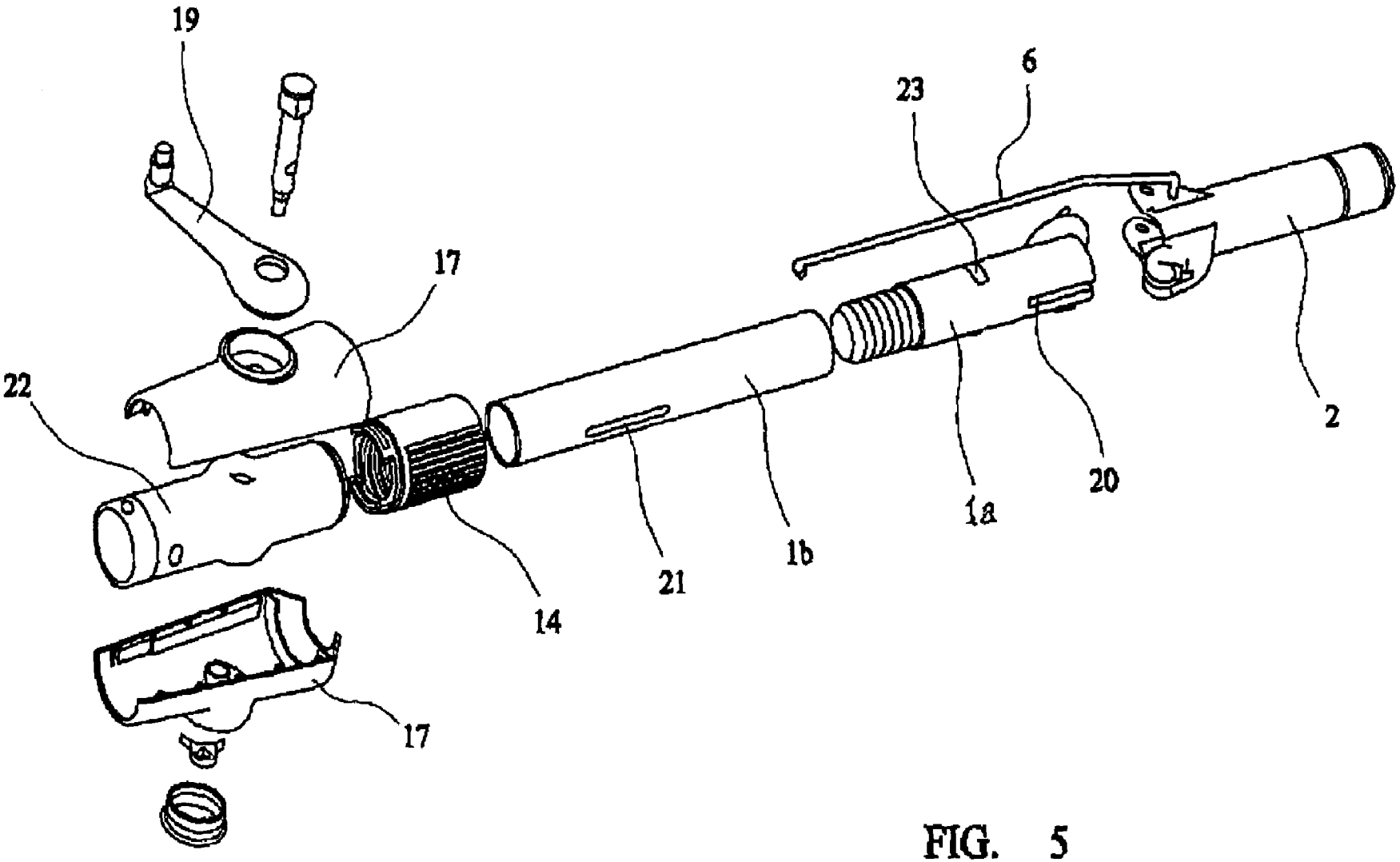

FIGS. 4*a* and 4*b* show the tilting mechanism of FIG. 3 on an umbrella shaft; and FIG. 5 shows an exploded perspective view of the tilting mechanism of FIG. 3 on an umbrella shaft.

DETAILED DESCRIPTION OF EMBODIMENTS

Figure 1:
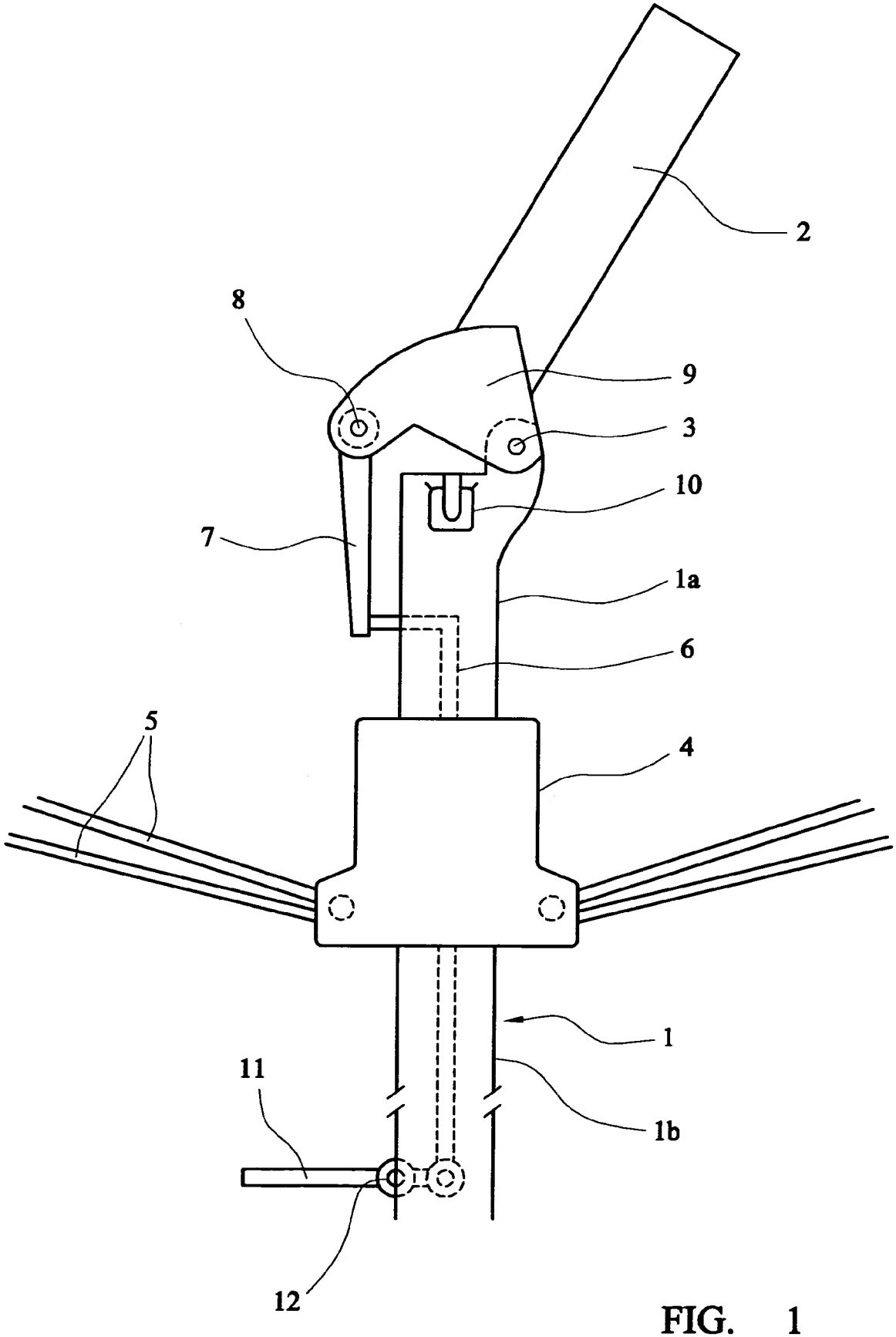
FIG. 1 shows a view of a runner and tilting mechanism assembly representing a first embodiment of the invention.

In FIG. 1 the relevant parts of an umbrella shaft in accordance with the invention are shown. It is in two parts, a lower part 1 and an upper part 2 pivoting on the lower about an axis 3. At the top of the upper part 2, though not shown, there is the usual head with ribs extending radially and supporting a cover. On the lower shaft part there is a slider or runner 4 from which extend, likewise radially and corresponding in number to the ribs, stretchers 5 meeting the ribs somewhere along their length so as to hold them extended with the cover taut when the umbrella is in use, i.e. with the runner in the uppermost position as shown. To fold the umbrella the runner 4 is slid down the lower shaft part 1 in the usual way, after releasing a catch.

The tilt action of the upper shaft is effected by an actuator including a lever 7 extending from an attachment point near the base of the upper shaft part 2 downwards alongside the lower shaft part 1 to a cranked connecting rod 6. The lever 7 is pivoted near its upper end on a pin 8 located parallel to, and at approximately the same height as, the pivot 3 in a suitably shaped base portion 9 of the upper shaft 2. The axes 3 and 8 lie on opposite sides of the central shaft axis. The other end of the lever 7 is attached by a suitable means to the uppermost end of the rod 6.

The lower shaft part 1 is in fact made in two sections, the upper or hinge section 1*a* and the lower section 1*b*, providing the main length of the shaft. This allows the main length to be made of simple metal tube, while the top of the hinge section 1*a* is moulded in plastics to provide the more complex hinge and runner-catch portions. The hinge section 1*a* of the lower shaft part 1 is sufficiently long to accommodate the lever 7, say about 20 cm long, and has an end portion with ridges for insertion into the lower section or pole 1*b*. At its top end, in the vicinity of and to one side of the hinge, the shaft section 1*a* has a boss 10 extending outwards, in which is a groove constituting a guide for a cord, not shown, used to raise the runner. On the opposite side to the hinge, i.e. to the axis 3, the upper section 1*a* has a slot through which the uppermost end of the rod 6 protrudes, as can be seen in FIG. 1. This end of the rod 6 is connected to the lever 7.

The rod 6 extends inside the lower shaft part 1, bypassing the runner, from the slot in the upper hinge section 1*a* to a second aperture or slot located in the lower section 1*b* in a position that is convenient for the user. If an auxiliary mechanism, such as a cord and crank, is present for raising the runner, this position can be close to that of the auxiliary mechanism, e.g. the crank. The lowermost end of the rod 6 extends as far as the second slot and is attached to a means for applying upward force to the rod 6, which in this embodiment is another lever 11. The rod is entirely independent of the runner and preferably does not touch it. The operating lever is pivoted on a pin 12 attached to the lower section 1*b* of the lower shaft part at the second slot.

The runner 4 could be of conventional construction, though in embodiments where the actuator is entirely outside the shaft there has to be some provision for a rod or other connector to pass through or past the runner. If the runner is designed to be raised manually it would have a descending sleeve adapted to the grip of an operator.

In terms of materials, both shaft parts 1, 2, the rod and the lever 7 can be made for instance of wood, a plastics material, a composite, a metal, or any suitable alloy, the latter particularly in the case of the shaft. Typically the hinge section 1*a* of the lower shaft part 1 can be made of a plastics material such as acetals or nylon, the pole of metal such as aluminium or steel, and the upper shaft section 2 of nylon. The levers 7, 11 can be made of acetals, while one or both parts of the runner 4 can be made of a cheaper plastics material such as HDPE (high-density polyethylene).

Operation of the umbrella from the folded state is as follows. The runner is first raised, by hand or by a mechanism such as a crank-operated cord passing up through the shaft, returning round the guide 10 and down to the runner 4, until the runner is raised sufficiently far for the ribs and stretchers 5 to be extended and the cover taut. At this point the runner is in its uppermost position. If the umbrella is to stay straight this is the end of the operation.

If the user wants to tilt the umbrella he simply pushes the lower lever 11 down, which results in the rod 6 moving upwards along the axis of the lower shaft part 1, and the upper lever 7 concomitantly travelling upwards and exerting a torque, via its attachment point 8, on the base portion 9, around the hinge 3 on the upper shaft part 2, thereby tilting the upper shaft part 2. The design of this embodiment of the invention is such that the tilt action is well counterbalanced, providing the additional benefit that only moderate force need be applied to the lower lever 11. During the tilt movement the runner does not move.

For the reverse operation the lower lever 11 is moved in the opposite direction. In this regard, it is advantageous that the rod 6 can also be used to pull the upper lever 7 downwards, because this allows a positive "untilting" operation as well as the tilting.

Figure 2:
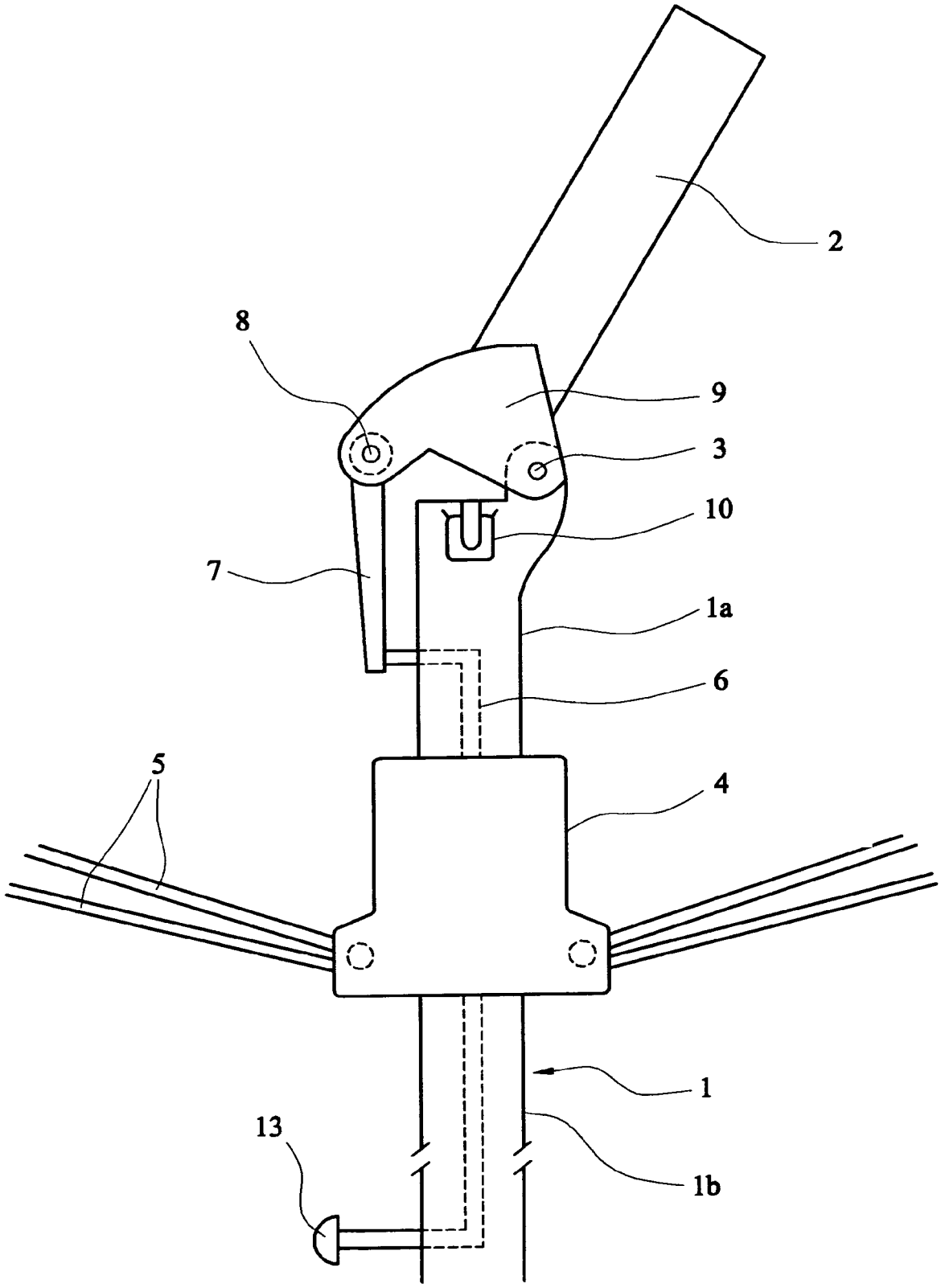
FIG. 2 shows a view of a runner and tilting mechanism assembly representing a second embodiment of the invention.

According to another embodiment of the invention the lowermost end of the actuator rod 6 extends through the second slot in the lower section 1*b* and simply has a handle or knob 13 attached to its end on the outside of the shaft, as shown in FIG. 2. In this embodiment, the user drives the actuator rod 6 directly up the shaft.

FIG. 3 shows an embodiment of the invention in which the "handle" of the actuator comprises a sleeve 14 surrounding the shaft with an internal recess in the form of a helical groove 15. In this example the sleeve has lugs 16, which engage under a casing 17 surrounding a connector body 22. The connector body 22 has a circumferential groove 24 in which the lugs 16 are retained so that the sleeve 14 can rotate without axial movement. The connector body houses a mechanism for raising and lowering the runner (not shown) and also acts to connect the shaft 1 to a base shaft, not shown. A handle (not shown) may be inserted in the hole 18 in the casing 17.

FIGS. 4*a* and 4*b* show the actuator of FIG. 3 in position on the shaft of the umbrella. The actuator rod 6 emerges from within the shaft and the protruding lower end of the actuator rod 6 engages in the helical screw thread 15 and is raised or lowered by rotating the sleeve 14. This has the advantage that it is, or can be made, self-locking. The lugs 16 can be seen under the casing 17. A handle 19 attached to the casing 17 is shown; this handle operates the mechanism for unfurling the umbrella, which is not shown. FIG. 4*b* also shows the ledge or catch 23 moulded on the upper section 1*a*, on which the runner rests in its upper position; it also remains there during the tilting procedure.

FIG. 5 shows an exploded view of the umbrella shaft shown in cross section in FIGS. 4*a* and 4*b*. In the assembled shaft the actuator rod 6 passes through a first slot 20 in the upper portion 1*a* of the lower shaft part. The rod 6 then passes through the lower portion 1*b* of the lower shaft part and emerges from a slot 21 in the lower portion. The sleeve 14 fits over the lower portion 1*b* so that the end of the actuator rod 6 emerging from the slot 21 engages with the screw thread 15. The casing 17 then fits over the connector body 22 and the sleeve 14 as shown in FIGS. 4*a* and 4*b*. This fitting must hold the sleeve so as to prevent longitudinal movement while allowing it to rotate freely. The axial extent of the sleeve determines the longitudinal movement of the rod, and hence the amount of tilt of the upper shaft part 2.

The invention claimed is:

1. An umbrella frame including:

an upper shaft part and a lower shaft part, the two parts being connected in such a way that the upper shaft part can tilt with respect to the lower shaft part;

a runner sliding on the lower shaft part, for spreading a cover on the umbrella frame into an unfurled configuration when slid upwardly; and an actuator connected to the upper shaft part and extending down the lower shaft part, through or past the runner when in the runner is in an upper position with the umbrella frame open, to an operating location on the lower shaft part, the actuator being accessible at a lower end of the actuator so that a user can tilt the upper shaft part.

2. An umbrella frame according to claim 1, wherein the actuator comprises a lever and cranked rod arrangement wherein the lever is disposed outside and extending along the upper shaft part, is pivotably connected to the upper shaft part at a top end of the lever, and is pivotably connected to the rod at a bottom end of the lever, an upper cranked end of the rod extending out through a substantially axial slot at a top of the lower shaft part and the body of the rod extending to an operating location below the upper position of the runner.

3. An umbrella frame according to claim 2, wherein a lower end of the rod extends outwards through a second substantially axial slot in the lower shaft.

4. An umbrella frame according to claim 2, wherein a lower end of the rod is connected to an operating lever at the operating location, enabling the upper shaft to be tilted by moving the operating lever.

5. An umbrella frame according to claim 1, wherein the actuator comprises a cranked rod arrangement, and wherein an upper cranked end of the rod connects directly to a pivot extension of the upper shaft part, horizontal movement of the pivot extension being accommodated by allowing the rod to slide through the pivot extension and/or by flexing of the rod.

6. An umbrella frame according to claim 5, wherein a lower end of the rod extends outwards through a second substantially axial slot in the lower shaft part.

7. An umbrella frame according to claim 5, wherein a sleeve surrounds the lower shaft part, the sleeve having an internal recess in the form of a substantially helical screw thread, a lower end of the rod protruding from a slot in the lower shaft part and engaging in the internal recess and the sleeve being rotatable about an axis of the lower shaft part, so that the lower end of the rod is raised or lowered by rotating the sleeve.

8. An umbrella frame according to claim 7, wherein the sleeve is incorporated into a mechanism used for unfurling the umbrella frame.

9. An umbrella frame according to claim 1, wherein the actuator comprises a cranked rod arrangement and a sleeve, where the sleeve surrounds the lower shaft part, the sleeve having an internal recess in the form of a substantially helical screw thread, a lower end of the rod protruding from a slot in the lower shaft part and engaging in the internal recess and the sleeve being rotatable about an axis at the lower shaft part, so that the lower end of the rod is raised or lowered by rotating the sleeve.

10. An umbrella frame according to claim 9, wherein the sleeve is incorporated into a mechanism used for unfurling the umbrella frame.

11. An umbrella frame according to claim 1, wherein a tilt axis of the upper shaft part is located radially outwards of the axis of the lower shaft part, and the attachment of the actuator to the upper shaft part is about a hinge, an axis of the hinge being generally on a level with and parallel to the tilt axis, on the opposite side of the axis of the lower shaft part.

12. An umbrella frame according to claim 1, further comprising raising means for raising the runner situated on the lower shaft part.

13. An umbrella frame according to claim 12, wherein the raising means comprises a crank.

* * * * *